US007488389B2

(12) United States Patent
Osawa

(10) Patent No.: US 7,488,389 B2
(45) Date of Patent: Feb. 10, 2009

(54) NOZZLE DEVICE, FILM FORMING APPARATUS AND METHOD USING THE SAME, INORGANIC ELECTROLUMINESCENCE DEVICE, INKJET HEAD, AND ULTRASONIC TRANSDUCER ARRAY

(75) Inventor: Atsushi Osawa, Kaisei-machi (JP)

(73) Assignee: FUJIFILM Corporation, Tokyo (JP)

( * ) Notice: Subject to any disclaimer, the term of this patent is extended or adjusted under 35 U.S.C. 154(b) by 114 days.

(21) Appl. No.: 11/083,950

(22) Filed: Mar. 21, 2005

(65) Prior Publication Data

US 2005/0211162 A1 Sep. 29, 2005

(30) Foreign Application Priority Data

Mar. 26, 2004 (JP) ..... 2004-093244

(51) Int. Cl.

| | |
|---|---|
| ***B05C 11/00*** | (2006.01) |
| ***B05C 19/00*** | (2006.01) |
| ***B05B 13/04*** | (2006.01) |
| ***B05B 3/02*** | (2006.01) |

(52) U.S. Cl. ..... 118/680; 118/686; 118/308; 118/309; 118/319; 118/321; 118/323

(58) Field of Classification Search ..... 118/308, 118/309, 305, 323, 679–681, 686, 52, 612, 118/56, 319–321, 687; 427/240, 180, 427.3, 427/424

See application file for complete search history.

(56) References Cited

U.S. PATENT DOCUMENTS

| | | | | |
|---|---|---|---|---|
| 6,349,668 | B1 * | 2/2002 | Sun et al. | 118/723 R |
| 6,660,332 | B2 * | 12/2003 | Kawase et al. | 427/266 |
| 2005/0098103 | A1 * | 5/2005 | Miyoshi | 118/712 |

FOREIGN PATENT DOCUMENTS

| | | | |
|---|---|---|---|
| EP | 1231294 | A1 * | 8/2002 |
| JP | 07-031575 | A | 2/1995 |
| JP | 2001348659 | A * | 12/2001 |
| JP | 2004-000654 | A | 1/2004 |

OTHER PUBLICATIONS

English Translated Detailed Description of JP 2001348659A.*

* cited by examiner

*Primary Examiner*—Yewebdar T Tadesse
(74) *Attorney, Agent, or Firm*—Sughrue Mion, PLLC

(57) ABSTRACT

A film forming apparatus by which uniform and large area films can be formed according to the AD method. The film forming apparatus includes: a film forming chamber; a substrate holder located in the film forming chamber, for holding a substrate on which a structure is to be formed; an exhaust pump for exhausting an interior of the film forming chamber; an aerosol generating unit for generating an aerosol by blowing up a raw material powder placed in a container with a gas; a carrier pipe for introducing the generated aerosol into the film forming chamber; a nozzle for spraying the aerosol introduced via the carrier pipe toward the substrate; and a control unit for chaotically changing a relative position of the substrate held by the substrate holder and the nozzle.

7 Claims, 10 Drawing Sheets

NOZZLE DEVICE, FILM FORMING APPARATUS AND METHOD USING THE SAME, INORGANIC ELECTROLUMINESCENCE DEVICE, INKJET HEAD, AND ULTRASONIC TRANSDUCER ARRAY

BACKGROUND OF THE INVENTION

1. Field of the Invention

The present invention relates to a nozzle device for spraying raw material powder toward a substrate so as to form a film, and a film forming apparatus and method using the device. Furthermore, the present invention relates to an inorganic electroluminescence (EL) device, an inkjet head and an ultrasonic transducer array fabricated by using such a film forming method.

2. Description of a Related Art

Recent years, when fabricating a hard and brittle material such as ceramics, it has been under study to use film forming technologies by which thick films can be formed without mixing a binder. Among them, the aerosol deposition (AD) method by which dense and strong thick films can be formed receives attention. The AD method is a film forming method of depositing the raw material by spraying ultrafine particles of a raw material toward a substrate so that the particles impinge on the substrate or a previously formed film. The AD method is also referred to as injection deposition method or gas deposition method.

In the AD method, when a film is formed in a region having a certain area, the substrate is scanned by using a nozzle for injecting ultrafine particles of the raw material. However, as the film forming area becomes larger, scanning with the nozzle must be repeated, and it takes a lot of time to forming a film. Accordingly, in response to the request to make the film forming region larger, the nozzle size has been made larger into a slit form, or the nozzle has been made to move over a broader range regularly. However, when the nozzle size is made larger, since it is difficult to stably supply an aerosol to the nozzle or to stably inject the aerosol from the nozzle, it is inevitable that streaky defects are produced in the formed film or the film thickness becomes nonuniform.

By the way, recent years, in various technology fields, phenomena based on the chaos theory have been utilized. According to Aihara (Department of Mathematical Engineering and Information Physics, the University of Tokyo), a chaos is defined as "a phenomenon in which, although a system changes according to a firm rule, the system behaves very complexly and unstably and a state in some distant future is completely unpredictable". Further, he also stated that, when one chaos exists, an infinite number of orders are included therein, and since the orders are inherent, the chaos can be predicted and controlled.

For example, in a film forming method in which a film forming source (e.g., target) has an area equal to or larger than a substrate like the sputtering method or the like, in order to fabricate a uniform film, sometimes the substrate is chaotically moved by giving the substrate rotation motion and revolution motion. This is because, when the substrate exhibits chaotic behavior, the substrate no longer traces the same track again because of orbit instability of chaos, and a uniform film can be formed over a broad range. However, in the AD method, unlike the sputtering method or the like, the nozzle as a film forming source can be regarded as small as a dot or line relative to the substrate. Accordingly, it is unsuitable for utilizing the above-described technique without change.

Further, Japanese Patent Application Publications JP-A-7-31575 (the first page, FIG. 1) and JP-P 2004-654A (the first page, FIG. 1) disclose that a nozzle formed by plural links is used and the nozzle is made into a chaotic state by setting injection angle of injection openings or the like to suitable values. By applying the orbit instability of chaos to the rotational nozzle device, water can be uniformly distributed from the nozzle. However, in the AD method, unlike the case of water distribution, since the injected ultrafine particles of the raw material must be deposited on the substrate, the above-described rotational nozzle device can not be applied to the method.

SUMMARY OF THE INVENTION

The present invention has been achieved in view of the above-described problems. An object of the present invention is to provide a film forming apparatus and method by which uniform and large area films can be formed according to the AD method, and a nozzle device to be used therein. A further object of the present invention is to provide an inorganic electroluminescence device, an inkjet head to be used in an inkjet printer, and an ultrasonic transducer array to be used in an ultrasonic probe, all of which are manufactured by using such a film forming method.

In order to solve the above-described problems, a nozzle device according to the present invention is a nozzle device to be used for spraying fluid mixed with powder to a region having a predetermined area, and including: at least one nozzle for injecting the fluid mixed with the powder; displacing means for supporting and displacing the at least one nozzle; and control means for controlling at least the displacing means such that the at least one nozzle exhibit chaotic behavior.

Further, a film forming apparatus according to the present invention includes: a film forming chamber; a substrate holder located in the film forming chamber, for holding a substrate on which a structure is to be formed; exhaust means for exhausting an interior of the film forming chamber; aerosol generating means for generating an aerosol by blowing up raw material powder placed in a container with a gas; introducing means for introducing the aerosol generated by the aerosol generating means into the film forming chamber; at least one nozzle disposed oppositely to the substrate held by the substrate holder in the film forming chamber, for spraying the aerosol introduced via the introducing means toward the substrate; and displacing means for chaotically changing a relative position of the substrate held by the substrate holder and the at least one nozzle.

Furthermore, a film forming method according to the present invention includes the steps of: (a) placing a substrate, on which a structure is to be formed, in a substrate holder located in a film forming chamber; (b) exhausting an interior of the film forming chamber; (c) generating an aerosol by blowing up raw material powder placed in a container with a gas; (d) introducing the aerosol generated at step (c) into the film forming chamber; and (e) spraying the aerosol introduced at step (d) from at least one nozzle toward the substrate in the film forming chamber while chaotically changing a relative position of the substrate held by the substrate holder and the at least one nozzle disposed oppositely to the substrate so as to deposit the raw material powder on the substrate.

An inorganic electroluminescence device according to the present invention includes: a first electrode layer; a first insulating layer including a thick film deposited on the first electrode layer by spraying powder of a material having dielectricity from a nozzle toward the first electrode layer while chaotically changing a relative position of the nozzle and the first electrode layer; a luminescent layer formed on the first insulating layer and including a material that exhibits electroluminescence; a second insulating layer formed on the luminescent layer; and a second electrode layer formed on the second insulating layer.

An inkjet head according to the present invention includes: a vibrating plate; a first electrode formed on a first surface of the vibrating plate; a plurality of piezoelectric materials deposited on the first electrode by spraying piezoelectric material powder from a nozzle toward the first electrode while chaotically changing a relative position of the nozzle and the first electrode; a plurality of second electrodes formed on the plurality of piezoelectric materials, respectively; at least one partition wall for forming a plurality of pressure chambers to be filled with a liquid by partitioning space on a second surface of the vibrating plate; and a nozzle plate disposed on the at least one partition wall and formed with a plurality of openings for discharging the liquid from the plurality of pressure chambers respectively.

An ultrasonic transducer array according to the present invention is an ultrasonic transducer array to be used for transmitting and receiving ultrasonic waves in an ultrasonic probe, and including: at least one first electrode; a plurality of piezoelectric materials deposited on the at least one first electrode in a predetermined arrangement by spraying piezoelectric material powder from a nozzle toward the at least one first electrode while chaotically changing a relative position of the nozzle and the at least one first electrode; and at least one second electrode formed on the plurality of piezoelectric materials.

According to the present invention, since the respective parts are formed such that the nozzle exhibits chaotic behavior, the nozzle traces completely irregular tracks within a movable range. By applying such a nozzle chaotically moving to the film forming apparatus, the raw material powder can be sprayed evenly over the substrate. Accordingly, a large area film having a uniform thickness, in which streaky defects are suppressed, can be formed. Therefore, thick films with good quality can be sufficiently fabricated, and the yield of products employing such thick films, for example, an inorganic EL device, inkjet head and ultrasonic transducer array can be improved.

DESCRIPTION OF THE PREFERRED EMBODIMENTS

Figure 1:
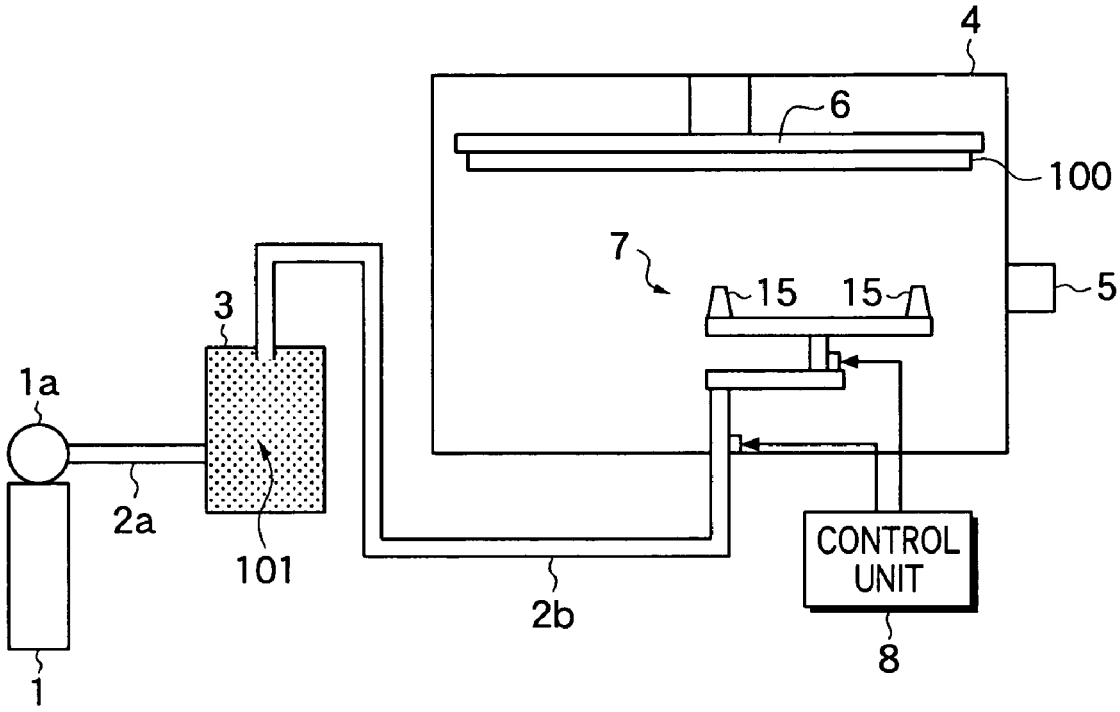
FIG. 1 is a schematic diagram showing the construction of a film forming apparatus according to the first embodiment of the present invention.

Hereinafter, embodiments of the present invention will be described in detail by referring to the drawings. The same reference numerals are assigned to the same component elements and the description thereof will be omitted.

FIG. 1 is a schematic diagram showing a film forming apparatus according to the first embodiment of the present invention. This film forming apparatus is according to the aerosol deposition (AD) method of depositing a raw material by spraying an aerosol containing the raw material powder toward a substrate.

The film forming device as shown in FIG. 1 includes a compressed gas cylinder 1, carrier pipes 2*a* and 2*b*, an aerosol generating chamber 3, a film forming chamber 4, an exhaust pump 5, a substrate holder 6, a nozzle part 7, and a control unit 8.

The compressed gas cylinder 1 is filled with nitrogen ($N_2$), oxygen ($O_2$), helium (He), argon (Ar) or dry air to be used as a carrier gas. Further, a pressure regulating part 1*a* for regulating the supplied amount of the carrier gas is provided to the compressed gas cylinder 1.

The aerosol generating chamber 3 is a container in which micro powder of a raw material is placed. By introducing the carrier gas from the compressed gas cylinder 1 via the carrier pipe 2*a* into the aerosol generating chamber 3, the raw material powder placed there is blown up to generate an aerosol. The generated aerosol is supplied via the carrier pipe 2*b* to the nozzle part 7.

The interior of the film forming chamber 4 is exhausted by the exhaust pump 5, and thereby, maintained at predetermined degree of vacuum. Further, in the film forming chamber 4, the substrate holder 6 for holding a substrate 100 is disposed.

Figure 2:
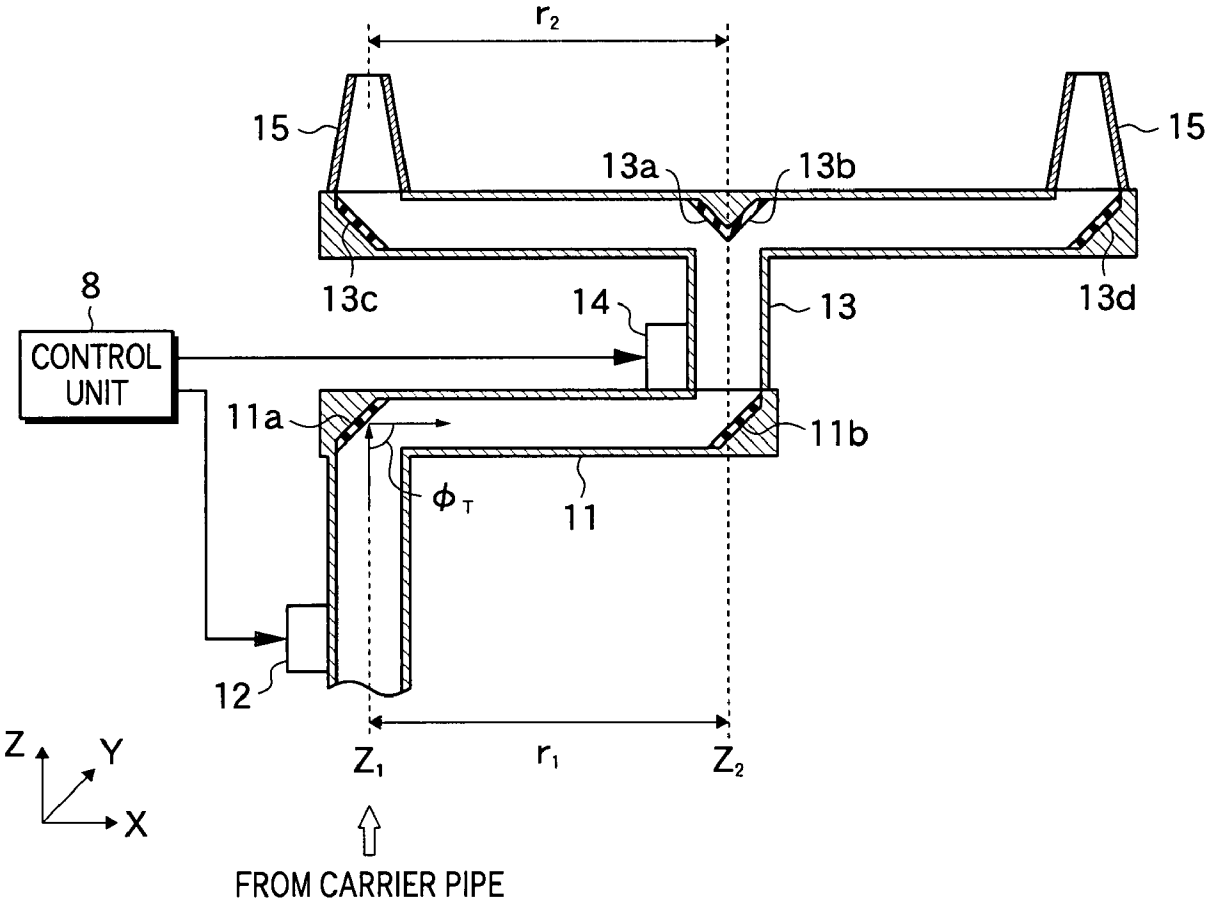
FIG. 2 is a schematic diagram showing the construction of a nozzle part as shown in FIG. 1.

FIG. 2 is a diagram for explanation of the structure of the nozzle part 7 as shown in FIG. 1. In order to chaotically move a nozzle for injecting the aerosol, the nozzle part 7 has a structure such that the nozzle is mounted on a displacement body (a support that is slidable and/or rotatable) having at least two rotation axes. It is known that, in the structures connected to each others such that plural degrees of freedom thereof overlap, the most end thereof shows chaotic behavior.

As shown in FIG. 2, the nozzle part 7 includes a first rotating tube 11, a first driving part 12 for rotating the first rotating tube 11, a second rotating tube 13, a second driving part 14 for rotating the second rotating tube 13, and two nozzles 15. The rotating tubes 11 and 13 are supports for supporting the nozzles 15, and carrying paths for carrying an aerosol are formed in the tubes. Further, the driving parts 12 and 14 are controlled by the control unit 8 to rotate the rotating tubes 11 and 13 at angular speeds of $\omega_1$ and $\omega_2$, respectively.

The rotating tube 11 includes a rotation axis portion having a rotation axis $Z_1$ and an arm portion extending from the rotation axis to the outside and makes rotary motion with the rotation axis $Z_1$ as a center thereof. The position of the rotation axis $Z_1$ is fixed relative to the film forming chamber 4 as shown in FIG. 1. Further, at the corners of the rotation tube 11, reflection plates 11*a* and 11*b* are disposed.

On the other hand, the rotating tube 13 includes a rotation axis portion having a rotation axis $Z_2$ and two arm portions extending from the rotation axis to the outside. The rotating tube 13 is provided on the end of the arm apart from the rotation axis $Z_1$ of the rotating tube 11 by a distance $r_1$, and makes rotary motion with the rotation axis $Z_2$ as a center thereof. At the corners of the rotation tube 13, reflection plates 13*a* to 13*d* are disposed. The two nozzles 15 are respectively provided on the ends of the two arms apart from the rotation axis $Z_2$ of the rotation tube 13 by a distance $r_2$, and move within the XY plane with the rotary motions of the rotating tubes 11 and 13.

Here, it is necessary that the rotation radius $r_1$ of the rotation axis of the rotating tube 13 and the rotation radius $r_2$ of the two nozzles 15 satisfy the relationship of $r_1 \leqq r_2$ in order to form a film over the entire substrate with no space. This is because, if $r_1 > r_2$, the central region of the substrate can not be deposited.

When the aerosol is introduced via the carrier pipe $\mathbf{2}_a$ into the nozzle part 7, the aerosol is carried from the rotation axis portion of the rotating tube 11 through the arm portion to the rotating tube 13. Furthermore, the aerosol is split from the rotation axis portion of the rotating tube 13 into two arm portions, and injected from the nozzles 15 provided on the ends of the arm portions, respectively.

As shown in FIG. 2, since the carrying path of the aerosol is not linear, when the aerosol traveling straight collides with the end of the path, it is possibly that the raw material powder may be deposited within the carrying path. Accordingly, in the embodiment, the reflection plates 11*a* and 11*b* and 13*a* to 13*d* are provided at the corners of the rotating tubes 11 and 13.

The angles at which the reflection plates are set are desirably determined through the following process. That is, assuming that an angle formed by the direction in which the aerosol flows in and the direction in which the aerosol that has been turned around at the corner flows out is $\phi_T$, the reflection plate is set such that the reflection surface of the reflection plate may form angles of $\phi_T/2$ with each of the inflow direction and the outflow direction of the aerosol.

As a material of the reflection plate, a material with which the raw material powder contained in the aerosol easily comes into elastic collision is desirably used. For example, in the case where a film of a hard and brittle material such as ceramics or a hard material such as metals is formed, a plate coated with an elastic material such as urethane rubber and silicon rubber is suitably used as the reflection plate. Thereby, the aerosol can be allowed to smoothly flow in the carrying path without occurrence of clogging therein. By the way, it is conceivable that the raw material powder is decelerated when reflected by the reflection plate. However, even in such a case, the speed of the carrier gas is hardly reduced. Therefore, there is no problem because, even when the raw material powder is once decelerated at the corner, it will be accelerated again afterwards.

Next, the operation of the film forming apparatus according to the embodiment will be described.

First, the substrate 100 made of silicon (Si), glass, ceramics, or the like is placed on the substrate holder 6 of the film forming chamber 4 as shown in FIG. 1, and kept at predetermined temperature. Further, the air inside of the film forming chamber 4 is exhausted by the exhaust pump 5 to a predetermined degree of vacuum. Then, raw material powder of ceramics or the like is placed in the aerosol generating chamber 3 and the carrier gas from the compressed gas cylinder 1 is supplied at a predetermined flow rate. Thereby, in the aerosol generating chamber 3, the raw material powder is blown up to generate an aerosol 101. On the other hand, under the control of the control unit 8 as shown in FIG. 2, the operation of the driving parts 12 and 14 is started. Thereby, the rotating tubes 11 and 13 rotate, and the nozzles 15 moves within the XY plane. The aerosol 101 is supplied to the nozzle part 7 and sprayed from the nozzles 15 toward the substrate 100, and thereby, the raw material powder adheres to the substrate and the deposit on the substrate to form a thick film of ceramics or the like.

Next, the motion of the nozzle part 7 will be described in detail. In the embodiment, the displacement body (the first and second rotating tubes) having two degrees of freedom is used to support the nozzles 15 such that the nozzles 15 may exhibit chaotic behavior. This is because, when the motion of the nozzle 15 comes into a chaotic state, the nozzle 15 never travels in the same orbit twice because of the orbit instability due to the chaotic state. However, even when the displacement body has two or more degrees of freedom, the most end of the displacement body does not necessarily exhibit the chaotic behavior, and certain conditions are required to be satisfied. Accordingly, in the embodiment, the lengths etc. of the rotating tubes 11 and 13 are designed and they are given rotary motion at angular speeds according thereto such that the nozzles 15 provided on the most ends of the displacement body may exhibit the chaotic behavior.

Here, as a characteristic amount for discriminating whether the behavior of the motion system is chaotic or not, the largest Lyapunov exponent, fractal dimension, Lyapunov dimension, etc. are known. In the embodiment, the largest Lyapunov exponent within them is used for designing the nozzle part and setting the driving conditions thereof.

One characteristic of the chaotic behavior is that two points close to each other become exponentially separated. For example, in the case where a difference between two points on an attractor is $\epsilon_0$ at a certain time, after a period of time "t" has elapsed, the difference expands to $\epsilon_0 \exp(\lambda t)$. Here, the motion of a dissipation system (a system that energy enters and exits from) settles in a specific point or orbit after a transient state, and such asymptotic behavior (stable state) is referred to as "attractor". As can be clearly seen from the above relationship, if $\lambda<0$, the difference of two points contracts, and if $\lambda=0$, the difference of two points is unchanged. In these cases, the response becomes not orbit instable. Therefore, by taking an average value of the exponents (an average expanding speed) over a long period of time with respect to a certain orbit, the orbit instability as a characteristic of the chaotic behavior can be quantified. The average value of the exponents is referred to as a Lyapunov exponent. In the case where the orbit instability is evaluated in a real dynamical system, when the largest Lyapunov exponent of the system is at least positive, the dynamical system is regarded as a system having orbit instability.

Next, a method of obtaining the largest Lyapunov exponent will be described by referring to FIG. 3. In the embodiment, the method will be described by using, for example, a technique that has been shown by Wolf et al. (Alan Wolf, Jack B. Swift, Harry L. Swinney and John A. Vastano, "DETERMINING LYAPUNOV EXPONENTS FROM A TIME SERIES", Physica, Vol. 16D, pp. 285-317, 1985).

Figure 3:
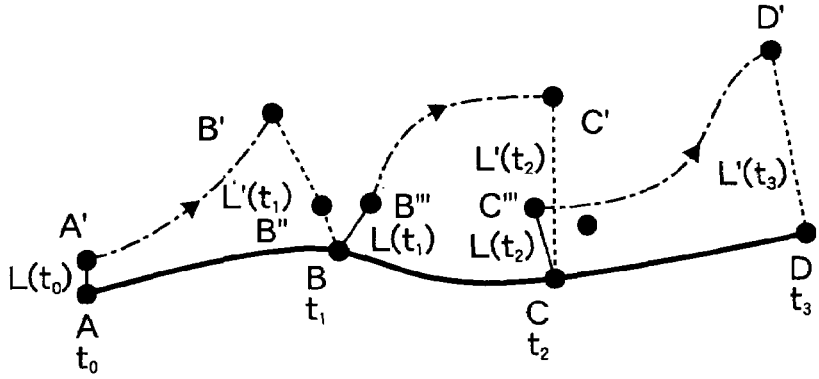
FIG. 3 is a diagram for explanation of a method of obtaining the largest Lyapunov exponent.

In FIG. 3, assuming that a reference orbit ABCD is the orbit of a nozzle. With point A in the orbit at the time to as a target, the vicinity of A on the attractor is searched to obtain point A'. The magnitude of the minute displacement between these point A and point A' is the magnitude $L(t_0)$ of vector AA'. These point A and point A' move to point B and point B' after a period of time $\Delta t_1=t_1-t_0$ has elapsed (at time $t_1$), respectively, and the minute displacement between the points changes to $L'(t_1)$. Thereby, the rate of expansion $L'(t_1)/L(t_0)$ of the orbit in the period $\Delta t_1$ is obtained.

Then, the minute displacement $L'(t_1)$ at time $t_1$ is normalized to obtain minute displacement vector BB". Subsequently, the vicinity of the minute displacement vector BB" on the attractor is searched to obtain vector BB"' that forms a sufficiently small angle with the vector BB". Then, point B"' is used in place of point B' to obtain the minute displacement $L(t_1)$ (the magnitude of vector BB"') and obtain the minute displacement $L'(t_2)$ (the magnitude of vector CC') when the point B and point B"' move to point C and point C' respectively after a period of time $\Delta t_2=t_2-t_1$ has elapsed. Thereby, the rate of expansion $L'(t_2)/L(t_1)$ of the orbit in the period $\Delta t_2$ is obtained.

Here, the reason why the rate of expansion in the next period is obtained by using point B"' in place of point B' is, for example, to prevent $L'(t_1)$ from developing to the size of the attractor when the period $\Delta t_1=t_1-t_0$ is taken longer.

Similarly, the rates of expansion $L'(t_3)/L(t_2)$, $L'(t_4)/L(t_3)$, . . . in the periods $\Delta t_3$, $\Delta t_4$, . . . are sequentially obtained. Thereby, the rate of expansion in period $\Delta t$ ($\Delta t=t_0$ to $t_M$) is obtained as follows.

$$\lambda_1 \cdot (t_M - t_0) = \sum_{k=1}^{M} \log_2 \frac{L'(t_k)}{L(t_{k-1})} \tag{1}$$

Further, the largest Lyapunov exponent $\lambda_1$ is obtained as follows.

$$\lambda_1 = \frac{1}{t_M - t_0} \sum_{k=1}^{M} \log_2 \frac{L'(t_k)}{L(t_{k-1})} \tag{2}$$

See "Theories and Applications of Chaotic Time Series Analysis", edited by Kazuyuki Aihara (Sangyo Tosho Inc. in Japan, 2000), which is incorporated herein by reference. Moreover, not only the method, but also various methods can be used to obtain the largest Lyapunov exponent.

When the nozzle part 7 as shown in FIG. 1 is designed, by computer simulation, lengths of arms and angular speeds $\omega_1$ and $\omega_2$, etc. are obtained such that the largest Lyapunov exponent $\lambda_1$ becomes more than zero. Alternatively, the Lyapunov exponent $\lambda_1$ is calculated while observing the orbit of nozzle using a CCD camera or the like, and lengths of arms and angular speeds $\omega_1$ and $\omega_2$, etc. with which the largest Lyapunov exponent becomes more than zero may be obtained.

As described above, in the embodiment, by providing the nozzles on the ends of the displacement body of two axes, the nozzles are allowed to move chaotically. Thereby, the orbits of the nozzles becomes completely irregular, and never travel in the same path. Therefore, by injecting the aerosol from such nozzles toward the substrate, the raw material powder can be sprayed evenly over the substrate and deposited. Since the instability at the times of supply and injection of aerosol is cancelled, a uniform thick film in which streaky defects are suppressed can be formed over a broad region.

By the way, in the embodiment, the nozzle part is formed by using the displacement body of two axes having two degrees of freedom, however, a displacement body of two or more axes may be used. That is, by overlapping two or more degrees of freedom, the most ends of the displacement body can be moved completely irregularly according to the chaotic theory.

Further, in the embodiment, the nozzles 15 as shown in FIG. 1 are brought into two-dimensional motion within the XY plane, however, they may be brought into three-dimensional motion including Z axis direction. In this case, by using a characteristic amount representing a chaotic state such as the largest Lyapunov exponent, the driving parts etc. may be controlled such that the nozzles 15 may exhibit three-dimensional chaotic behavior.

Furthermore, the nozzle motion is brought into not only the spatial chaotic state as in the embodiment, but also it may be brought into a temporal chaotic state. For example, by controlling the switching between on and off in the nozzle by using an irregular pulse, the aerosol can be chaotically injected. Alternatively, the flow rate of the aerosol injected from the nozzle may be changed along a sine curve.

In the embodiment, by providing two arms in the rotating tube 13, the two nozzles are located on the ends of the arms, respectively. However, the number of nozzles may be one, or three or more. Further, one nozzle may be located in each arm, or plural nozzles may be located on one arm. The reduction of injection speed of the aerosol can be suppressed with smaller number of nozzles, while the larger number of nozzles can shorten the time required for film formation. Therefore, the number of arms is set according to the substrate area, nozzle aperture area, or the like, and the film forming condition for aerosol injection pressure may be adjusted according thereto. In any case, since it is necessary to chaotically move all nozzles, the rotation radiuses of nozzles, angular speeds of the respective parts and so on are set by using the characteristic amount representing the chaotic state.

Next, a film forming apparatus according to the second embodiment of the present invention will be described by referring to FIG. 4. The film forming apparatus according to the embodiment chaotically moves the substrate side unlike the first embodiment.

Figure 4:
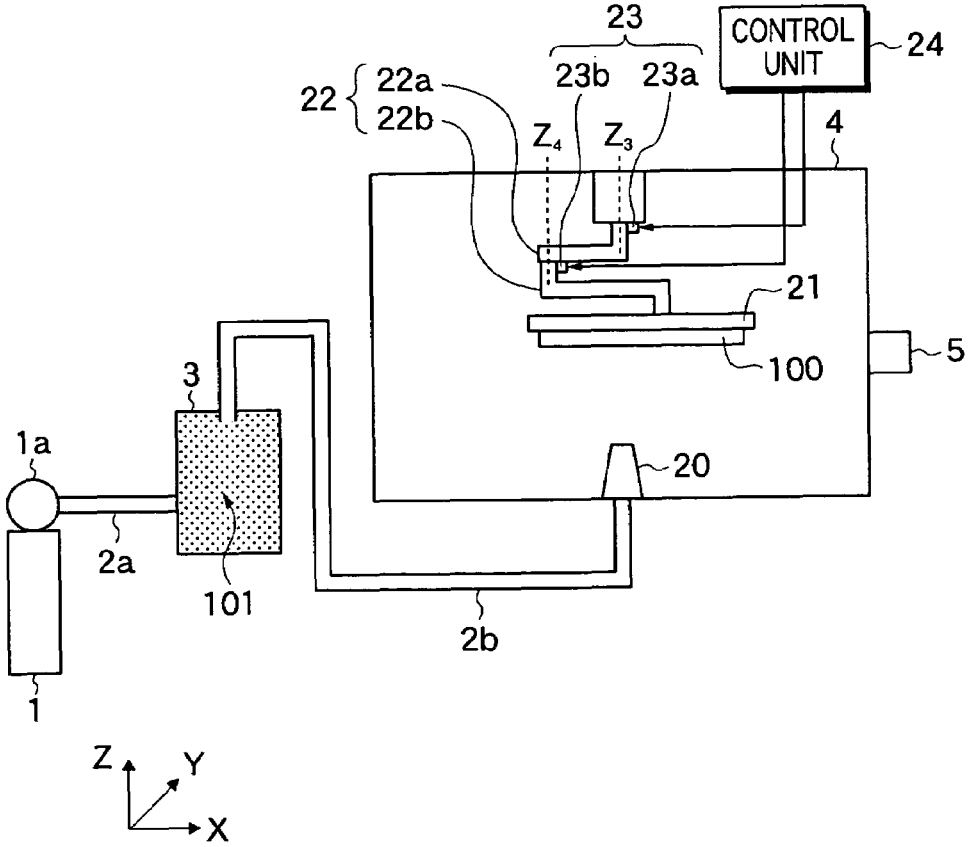
FIG. 4 is a schematic diagram showing the construction of a film forming apparatus according to the second embodiment of the present invention.

As shown in FIG. 4, the film forming apparatus according to the embodiment has a nozzle 20 fixed to the film forming chamber 4 and a substrate holder 21 for holding the substrate 100, in place of the nozzle part 7 and substrate holder 6 as shown in FIG. 1. Further, the film forming apparatus further includes a substrate holder supporting part 22 having at least two rotation axes, a substrate driving part 23 for driving the substrate holder supporting part 22, and a control unit 24. Other construction is the same as that shown in FIG. 1.

The substrate holder supporting part 22 includes a first rotating rod 22*a* rotating with a rotation axis $Z_3$ as the center thereof and a second rotating rod 22*b* rotating with a rotation axis $Z_4$ that is an end of the rotating rod 22*a* as the center thereof. The substrate holder 21 is provided on an end of the rotating rod 22*b*Further, the substrate driving part 23 includes a first driving part 23*a* for bringing the rotating rod 22*a* into rotary motion and a second driving part 23*b* for bringing the rotating rod 22*b* into rotary motion. The driving parts 23*a* and 23*b* are controlled by the control unit 24 to rotate the rotating rods 22*a* and 22*b* at predetermined angular speeds $\omega_1$ and $\omega_2$ respectively.

When a film is formed, the angular speeds of the rotating rod 22*a* and rotating rod 22*b* are respectively set based on the characteristic amount representing the chaotic state so that the end of the rotating rod 22*b* exhibits chaotic behavior. Thereby, the substrate holder 21 provided on the end of the rotating rod 22*b* and the substrate 100 held there chaotically move within the XY plane. By injecting the aerosol from the nozzle 20 toward the substrate 100, a uniform film can be formed evenly on the substrate 100.

In the above-described first and second embodiments of the invention, one of the nozzle and the substrate side is fixed and the other is chaotically moved, however, both of them may be moved such that the nozzle and substrate may relatively exhibit chaotic behavior.

Figure 5:
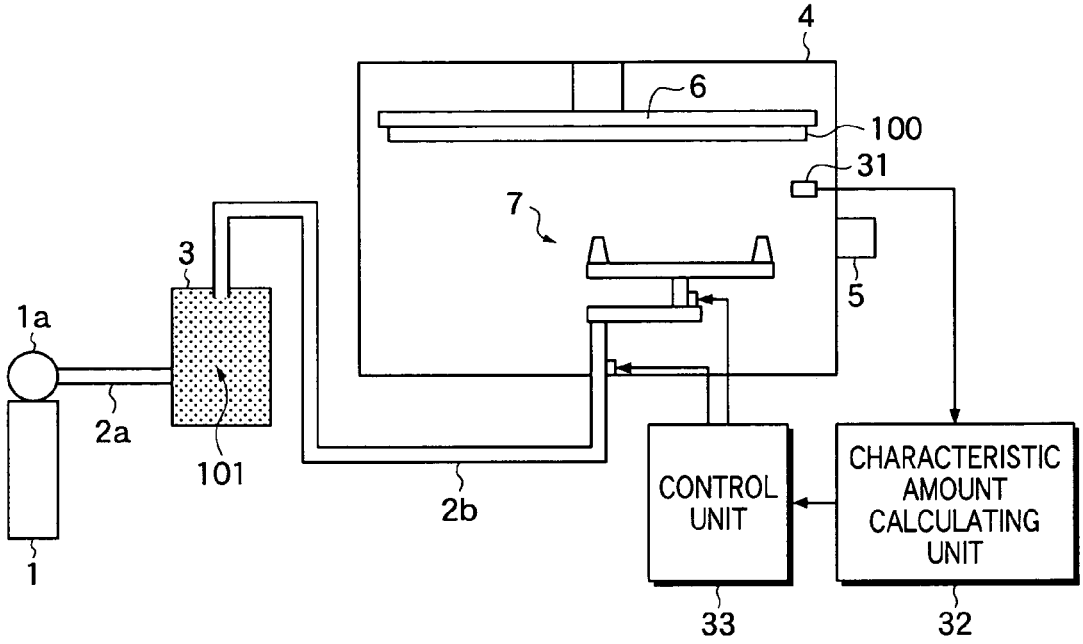
FIG. 5 is a schematic diagram showing the construction of a film forming apparatus according to the third embodiment of the present invention.

Next, a film forming apparatus according to the third embodiment of the invention will be described by referring to FIG. 5. As shown in FIG. 5, the film forming apparatus according to the embodiment includes a monitor unit 31 and a characteristic amount calculating unit 32 in addition to the film forming apparatus shown in FIG. 1, and has a control unit 33 in place of the control unit 8 as shown in FIG. 1. Other construction is the same as that shown in FIG. 1.

The monitor unit 31 is formed by a CCD camera, for example. The monitor unit 31 images the nozzles 15 during film formation and outputs image information representing the tracks of the nozzles 15. Further, the characteristic amount calculating unit 32 calculates a characteristic amount representing the chaotic state such as the largest Lyapunov exponent based on the image information outputted from the monitor unit 31.

The control unit 33 controls the operation of the driving parts 12 and 14 (FIG. 2) based on the characteristic amount calculated by the characteristic amount calculating unit 32. For example, in the case where the characteristic amount is the largest Lyapunov exponent, when the largest Lyapunov exponent becomes zero or less, the control unit 33 adjusts each angular speed of the rotating tube 11 or rotating tube 13 such that the largest Lyapunov exponent may become larger than zero again.

Thus, by monitoring the motion of the nozzles 15 and feeding back the obtained information, the nozzles 15 can be constantly placed in the chaotic state. Therefore, the state in which uniform film formation is performed can be constantly maintained.

Next, a film forming apparatus according to the fourth embodiment of the invention will be described by referring to FIGS. 6-8.

In the first embodiment of the invention, the carrier line for supplying the aerosol to the nozzles is provided inside of the rotating tubes that brings the nozzles into chaotic behavior, however, they are not necessarily integrated. For example, in the fourth embodiment, an aerosol carrier line for supplying an aerosol to a nozzle is provided separately from the rotation mechanism for bringing the nozzle into chaotic behavior.

Figure 6:
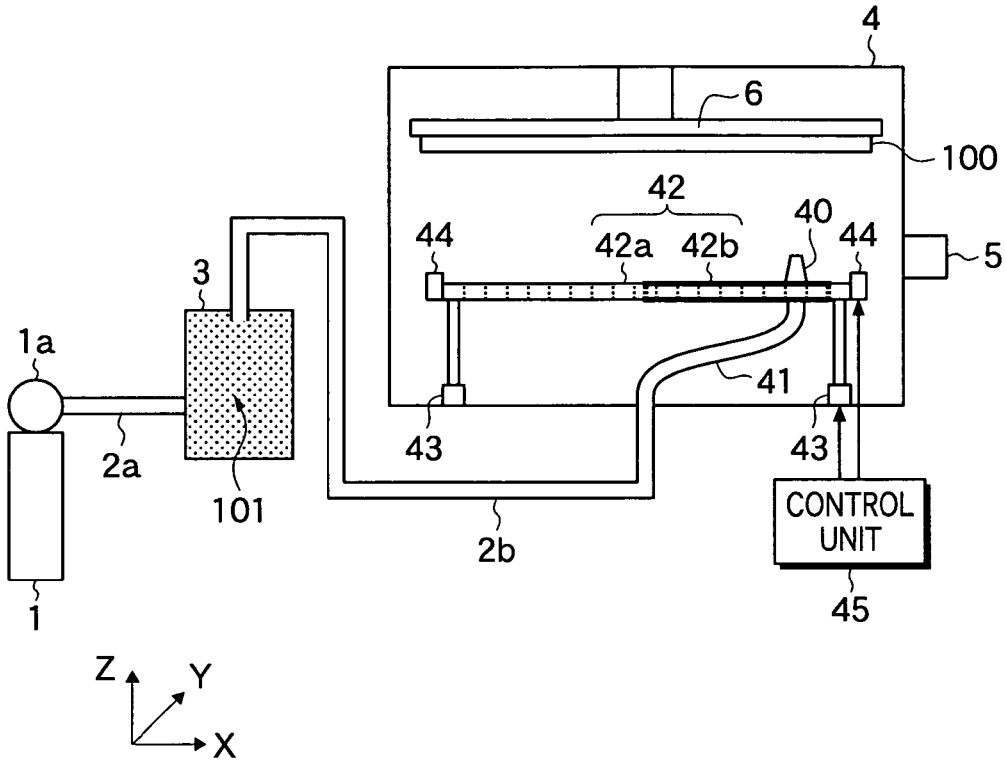
FIG. 6 is a schematic diagram showing the construction of a film forming apparatus according to the fourth embodiment of the present invention.

As shown in FIG. 6, the film forming apparatus has a nozzle 40 for injecting an aerosol, an aerosol carrier line 41, a rotating part 42, a first driving part 43, a second driving part 44, and a control unit 45, in place of the nozzle part 7 and control unit 8 as shown in FIG. 1. Other construction is the same as that shown in FIG. 1. The aerosol carrier line 41 is connected to the carrier pipe 2*b* and formed by a material having elasticity so as to follow the movement of the nozzle 40.

Figure 7:
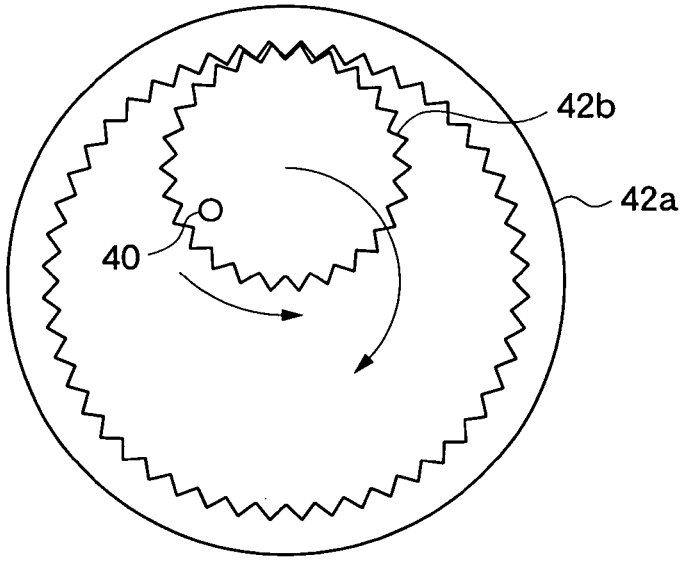
FIG. 7 is a top view showing a nozzle and a rotating part as shown in FIG. 6.

FIG. 7 is a top view showing the nozzle 40 and the rotating part 42. The rotating part 42 includes a rotary frame 42*a* and a rotary table 42*b* combined by a gear. The driving part 43 for vibrating the rotary frame 42*a* under the control of the control unit 45 is provided to the rotary frame 42*a*. By the way, the driving part 43 may be vibrated in a one-dimensional or two-dimensional manner in the XY plane, or may be vibrated in a three-dimensional manner in the XYZ space. The rotary table 42*b* performs rotary motion including rotation and revolution along the rotary frame 42*a*. Further, the nozzle 40 is provided to the rotary table 42*b*. The nozzle 40 moves within the rotary frame 42*a* while depicting the orbit determined by the radiuses and the number of gears of the rotary frame 42*a* and the rotary table 42*b* according to the rotary motion of the rotary table 42*b*.

Figure 8:
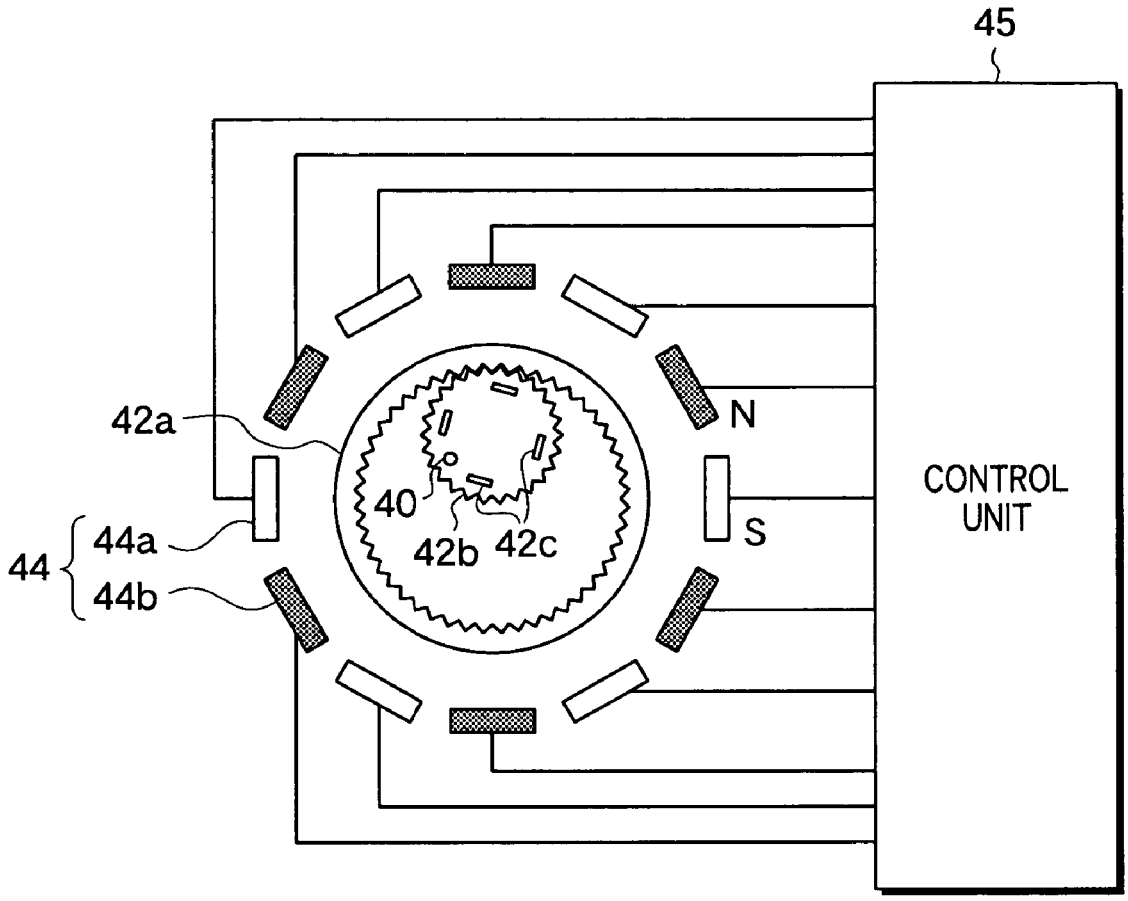
FIG. 8 is a schematic diagram showing a specific example of a mechanism for giving rotary motion to a rotary table as shown in FIG. 7.

FIG. 8 is a schematic diagram showing a specific example of a mechanism for bringing the rotary table 42*b* into rotary motion. As shown in FIG. 8, the driving part 44 includes plural coils (electromagnets) 44*a*, 44*b*, . . . arranged in the circumference of the rotary frame 42*a*. These coils 44*a*, 44*b*, . . . are arranged such that the magnetic fields generated from the adjacent coils are oriented in the opposite directions to one another. The control unit 45 controls the driving part 44 to reverse the orientations of those magnetic fields with predetermined cycles. As shown in FIG. 8, permanent magnets 42*c* are arranged on the rotary table 42*b* and the orientations of the magnetic fields generated from the coils 44*a*, 44*b*, . . . are sequentially alternated under the control of the control unit 45, and thereby, the rotary table 42*b* can be brought into rotary motion. Alternatively, alternating current is allowed to flow in the plural coils 44*a*, 44*b*, . . . for formation of a rotating magnetic field and generation of induced current in the rotary table 42*b*, and thereby, the rotary table 42*b* may be brought into rotary motion by the interaction between them.

Thus, by combining the vibration of the rotary frame 42*a* and the rotary motion of the rotary table 42*b*, the nozzle 40 can be displaced under two degrees of freedom. At that time, the nozzle 40 can be moved such that it may trace the chaotic track by optimizing the vibration cycle of the rotary frame 42*b* and the rotation speed of the rotary table 42*a* based on the characteristic amount representing the chaotic state under control of the control unit 45.

According to the above-described present invention, since large area and uniform films can be formed by the AD method, the invention can be applied to, for example, the following fields.

First, an inorganic electroluminescence device according to one embodiment of the present invention will be explained.

Figure 9:
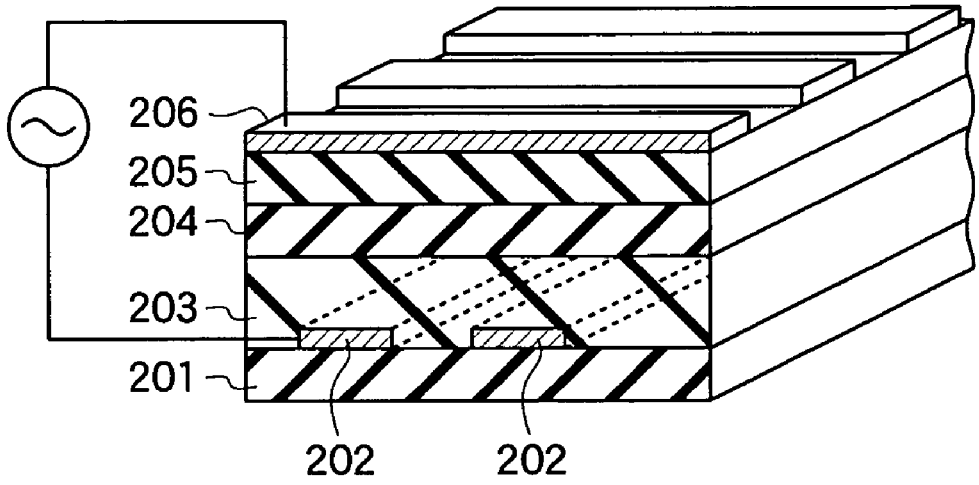
FIG. 9 is a partially sectional perspective view showing an inorganic electroluminescence device.

FIG. 9 is a partially sectional perspective view showing an inorganic electroluminescence (EL) device to be used for a display or the like. Generally, in an inorganic EL panel, dielectric films are provided on both ends of a luminescent layer that exhibits electroluminescence, and the present invention can be utilized when the dielectric films are formed.

The inorganic EL device as shown in FIG. 9 includes a substrate 201, first electrodes 202, a first insulating layer 203, a luminescent layer 204, a second insulating layer 205 and second electrodes 206. The substrate 201 is formed by ceramics such as alumina, for example. The first electrode 202 is formed by platinum (Pt) having a thickness of 200 nm, for example. The second electrode 206 is a transparent electrode formed by indium tin oxide (ITO) having a thickness of 200 nm, for example. A matrix circuit is formed by these first electrodes 202 and second electrodes 206.

The first insulating layer 203 and the second insulating layer 205 are formed by dielectric materials. The first insulating layer 203 is a PZT thick film having a thickness of 40 μm, for example. Further, the second insulating layer 205 is a silicon nitride (SiNx) thin film having a thickness of 200 nm, for example.

The luminescent layer 204 is formed by a material that exhibits electroluminescence. The luminescent layer 204 is a manganese addition zinc sulfide (ZnS:Mn) phosphor thin film having a thickness of 600 nm, for example.

Such an inorganic EL device is manufactured through the following process.

First, the substrate 201 of alumina or the like is prepared, a Pt thin film having a thickness of 200 nm is formed by the sputtering method, pattern formation is performed with respect to the Pt thin film by the photolithography method and dry etching method, and thereby, the first electrodes 202 are formed.

Then, on the substrate 201 on which the first electrodes 202 are formed, a PZT thick film is formed as the first insulating layer 203. At that time, as described in the first to fourth embodiments of the present invention, film formation by the AD method is performed while chaotically varying the relative position of the nozzle that injects PZT powder and the substrate. Further, in order to improve the crystallinity of the PZT, the PZT thick film is heat treated.

Then, on the first insulating layer 203, a ZnS:Mn thin film as the luminescent layer 204 is formed by the electron beam (EB) evaporation method. Then, on the luminescent layer 204, a thin film of SiNx (e.g., $Si_3N_4$) as the second insulating layer 205 is formed. This second insulating layer may be formed according to the sputtering method or may be formed according to the AD method that has been described in the first to fourth embodiments. Furthermore, on the second insulating layer 205, a thin film of ITO is formed according to the sputtering method, pattern formation is performed with respect to the ITO thin film according to the photolithography method and dry etching method, and thereby, the second electrodes 206 are formed.

Since the dense film (AD film) formed according to the AD method can reduce leak current, the dielectric film can be made thinner, and thereby, the driving voltage of the inorganic EL device can be reduced. When such a dielectric film is formed, by using the film forming method and film forming apparatus according to the present invention, an inorganic EL panel having a large area and low power consumption can be easily manufactured.

Next, an inkjet head according to one embodiment of the present invention will be explained.

Figure 10:
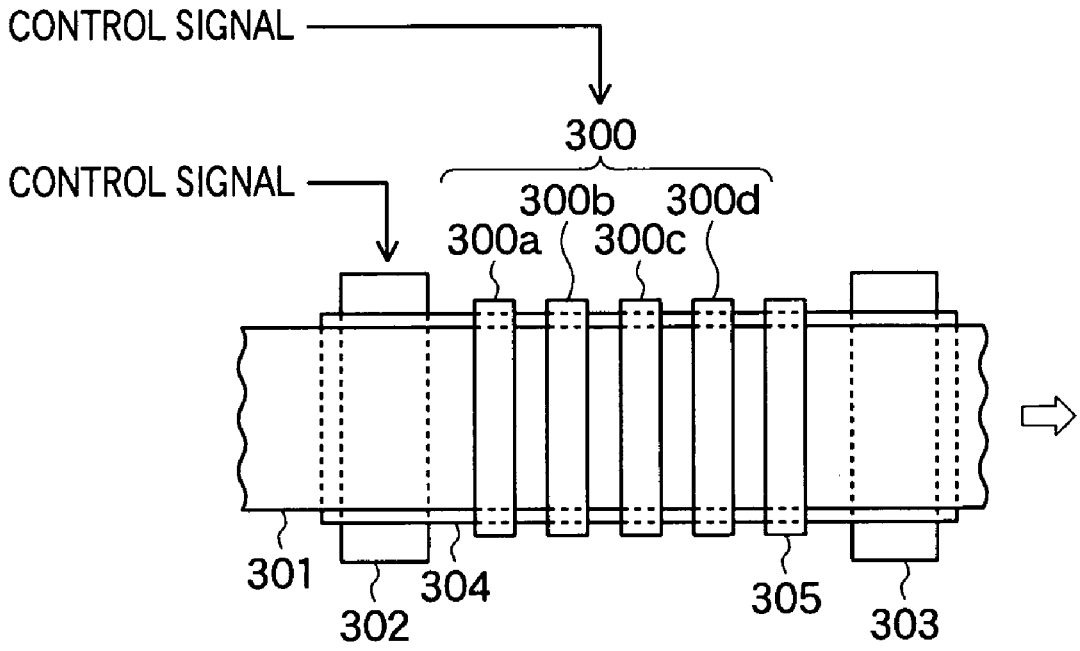
FIG. 10 is a plan view showing around a printing unit of an inkjet printer.
Figure 11:
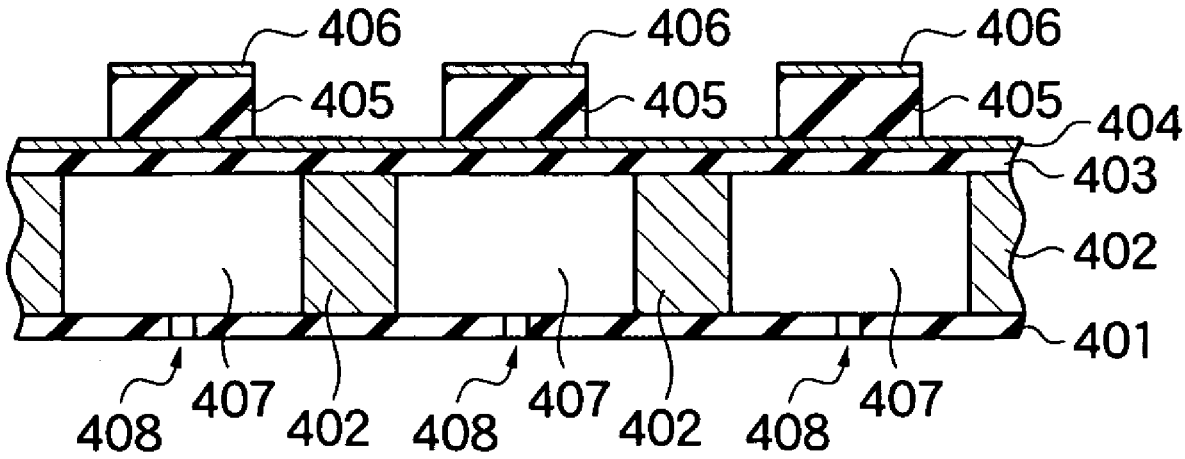
FIG. 11 is a sectional view showing part of an inkjet head as shown in FIG. 10.

FIG. 10 is a plan view showing around a printing unit of an inkjet printer, and FIG. 11 is a sectional view showing a part of a general inkjet head to be used in the printing unit. The present invention can be also utilized when such an inkjet head is manufactured.

Referring to FIGS. 10 and 11, a structure of the inkjet head (liquid discharge head) for discharging ink in the inkjet printer will be described. As shown in FIG. 10, the printing unit 300 is disposed above recording paper 301 held by suction onto a belt 304 over rollers 302 and 303. The recording paper 301 is fed in the direction of an arrow in FIG. 10 by the rollers 302 and 303 and belt 304 driven according to control signals. The printing unit 300 includes plural inkjet heads 300*a* to 300*d* for discharging ink. These inkjet heads 300*a* to 300*d* are linear heads having lengths corresponding to the paper width of the recording paper 301. Each of the inkjet heads 300*a* to 300*d* includes plural nozzle exits arranged along a direction perpendicular to the paper feed direction of the recording paper 301, and they discharge inks of black, cyan, magenta, yellow, respectively, according to the control signals to be supplied. A printing detecting unit 305 includes a line sensor for imaging printing results by the printing unit 300, and detects discharge defects such as clogging of nozzles based on images read by the line sensor.

FIG. 11 is a sectional view showing a part of each of the inkjet heads 300*a* to 300*d* as shown in FIG. 10. As shown in FIG. 11, the inkjet head includes a nozzle plate 401, partition walls 402, a vibrating plate 403, a first electrode 404, piezoelectric materials 405, and second electrodes 406. The partition walls 402 partition the space between the nozzle plate 401 and the vibrating plate 403 to form plural pressure chambers 407 filled with ink. In the nozzle plate 401, discharge openings 408 are formed as exits of ink to be discharged from the plural pressure chambers 407. Further, a piezoelectric element is formed by the piezoelectric material 405 and the electrodes 404 and 406 disposed on the upper and lower surfaces thereof. In FIG. 11, for simplicity of explanation, the mechanism for resupplying the ink to the respective pressure chambers 407 is omitted.

When printing is performed, voltages are applied between the electrodes 404 and the electrodes 406 according to control signals, respectively. Thereby, the piezoelectric materials 405 expand and contract by the piezoelectric effect and the vibrating plate 403 deforms. As a result, the volumes of the pressure chambers 407 are changed and the ink filling the interior is pressurized to drop down from the discharge openings 408.

Such an inkjet head is manufactured through the following process.

First, a silicon substrate having a thickness of about 30 μm to be used as the vibrating plate 403 is prepared, and the electrode 404 is formed on the first principal surface thereof according to the sputtering method or the like. Then, on the electrode 404, the plural piezoelectric materials 405 each having a bottom surface size of about 300 μm square and a thickness of about 30 μm are arranged in a two-dimensional matrix form at intervals of about 100 μm. For this purpose, a resist is arranged in a predetermined pattern on the electrode 404, a PZT thick film is formed thereon, and then, the resist is removed. In order to form the PZT thick film, as described in the first to fourth embodiments of the present invention, film formation by the AD method is performed while chaotically varying the relative position of the nozzle that injects PZT powder and the substrate on which the electrode 400 has been formed. Furthermore, the plural electrodes 406 are formed on the plural piezoelectric materials 405, respectively.

Further, a ceramics plate of alumina ($Al_2O_3$), zirconia ($ZrO_2$), or the like is prepared, holes as the pressure chambers 407 are formed by etching or the like, and thereby, the partition walls 402 are fabricated. Furthermore, another ceramic plate is prepared, holes as the ink discharge openings 408 are formed, and thereby, the nozzle plate 401 is fabricated.

These nozzle plate 401, partition walls 402, vibrating plate 403 on which the piezoelectric elements have been arranged are bonded by using an adhesive agent, and thereby, an inkjet head is completed.

Thus, a large number of piezoelectric materials having uniform thicknesses can be fabricated easily and efficiently by using the film forming method and film forming apparatus according to the present invention, and therefore, the invention can adequately respond to the recent requests for wider heads.

Alternatively, the partition walls and nozzle plate may be formed directly on a surface of the vibrating plate on the opposite side to the side on which the piezoelectric elements are arranged by using the film forming method and film forming apparatus according to the present invention. In this case, not only the wide head can be fabricated efficiently, but also no adhesive agent is required, and thereby, the durability and operation efficiency of the inkjet heat can be improved. Accordingly, a wide head having good characteristics can be fabricated such that high-speed printing may be performed and high viscosity ink such as pigment ink may be discharged.

Next, an ultrasonic transducer array according to one embodiment of the present invention will be explained.

Figure 12:
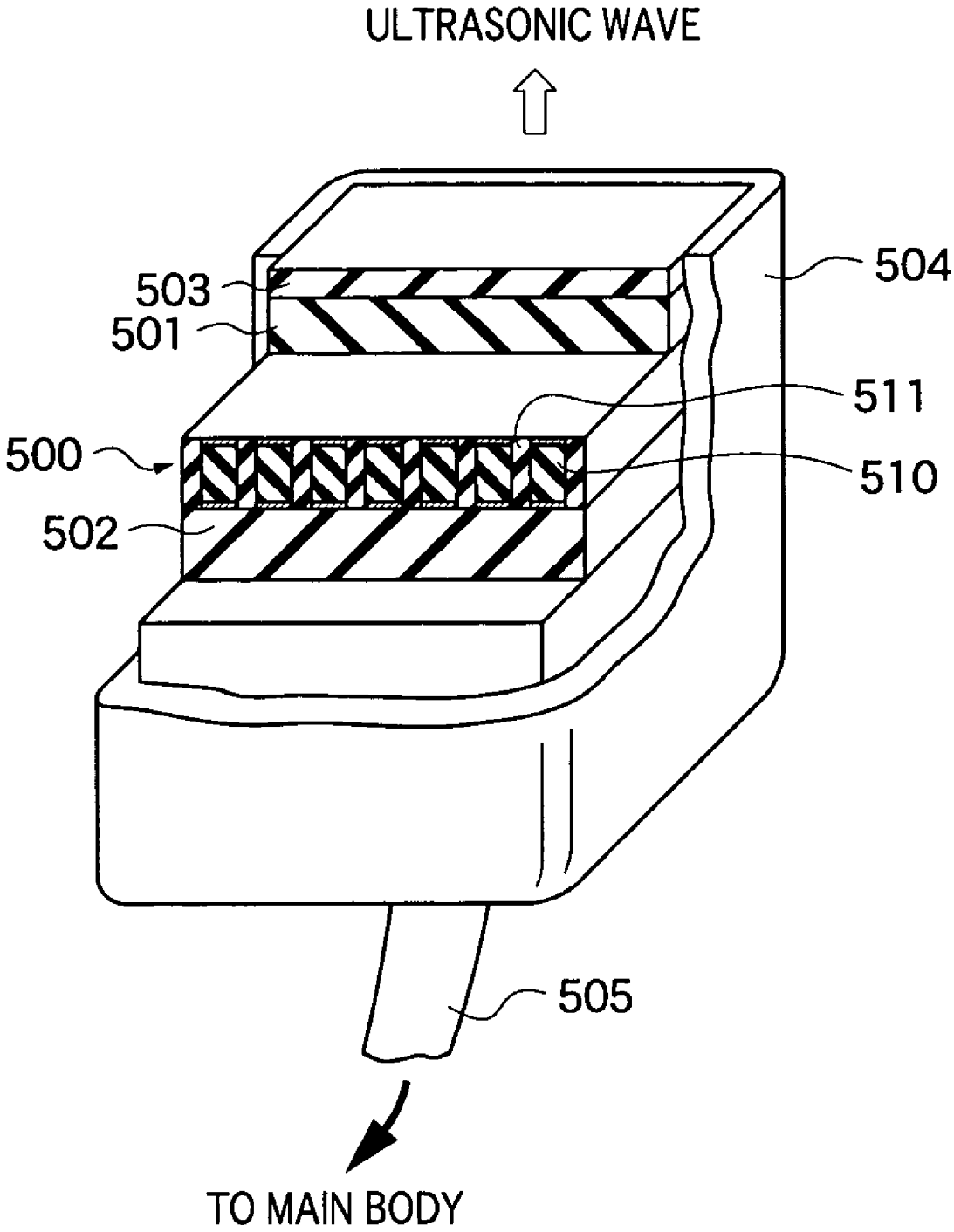
FIG. 12 is a partially sectional perspective view showing an ultrasonic probe.
Figure 13:
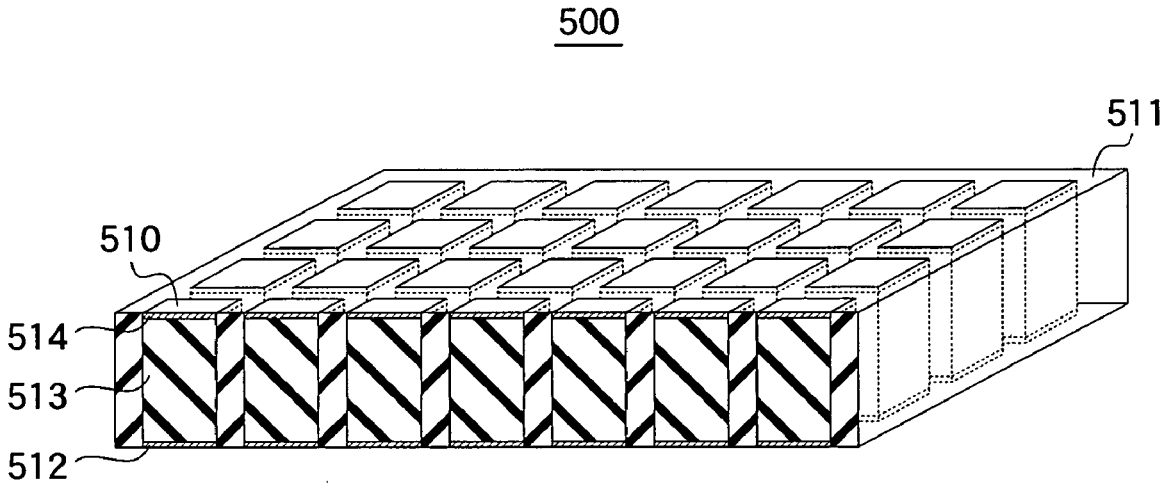
FIG. 13 is a partially sectional perspective view showing a two-dimensional ultrasonic transducer array to be used in the ultrasonic probe.

FIG. 12 is a partially sectional perspective view showing a structure of an ultrasonic probe to be used for ultrasonic diagnosis, and FIG. 13 is a partially sectional perspective view showing an ultrasonic transducer array to be used for transmitting and receiving ultrasonic waves in the ultrasonic probe as shown in FIG. 12. The present invention can be used when an ultrasonic transducer array is manufactured in which a large number of ultrasonic transducers are arranged.

This ultrasonic probe as shown in FIG. 12 includes an ultrasonic transducer array 500, at least one acoustic matching layer 501, a backing layer 502 and an acoustic lens 503. These parts 500 to 503 are accommodated in a casing 504. Further, wirings drawn from the ultrasonic transducer array 500 are connected via a cable 505 to an ultrasonic imaging apparatus main body.

The ultrasonic transducer array 500 includes plural ultrasonic transducers 510 for transmitting and receiving ultrasonic waves. Filling materials 511 such as epoxy resin are arranged between these ultrasonic transducers 510. The at least one acoustic matching layer 501 is formed by glass, ceramic, epoxy resin with metal powder, or the like that can transmit ultrasonic waves easily. The acoustic matching layer 501 eliminates a mismatch of the acoustic impedance between an object to be inspected as a living body and the ultrasonic transducer. Thereby, the ultrasonic wave transmitted from each ultrasonic transducer 510 propagates efficiently within the object.

The backing layer 502 is formed by a material providing large acoustic attenuation such as a material in which powder of ferrite, metal, or PZT is mixed in epoxy resin or rubber. The backing layer 502 rapidly attenuates unwanted ultrasonic wave generated by the ultrasonic transducer array 500. Further, the acoustic lens 503 is formed by silicon rubber, for example. The acoustic lens 503 focuses an ultrasonic beam, which has been transmitted from the ultrasonic transducer array 500 and passed through the acoustic matching layer 501, at a predetermined depth.

As shown in FIG. 13, in the ultrasonic transducer array 500, the plural ultrasonic transducers 510 are arranged in a two-dimensional matrix form at intervals of 100 μm, for example.

Each ultrasonic transducer 510 includes a lower electrode 512, a piezoelectric material 513 of PZT or the like, and an upper electrode 514, and has a bottom surface size of about 300 μm square and a thickness of about 10 μm, for example. When a voltage is applied between these lower electrode 512 and upper electrode 514, the piezoelectric material 513 expands and contracts by the piezoelectric effect and ultrasonic waves are generated. At that time, the plural ultrasonic transducers 510 are driven while providing predetermined delay times, and thereby, an ultrasonic beam transmitted in a desired direction is formed.

Such an ultrasonic transducer array 500 is fabricated through the following process.

First, the plural lower electrodes 512 are formed in a two-dimensional matrix form on a substrate by the sputtering method or the like. Next, a resist is formed in regions except for the plural lower electrodes 512 on the substrate. Then, as described in the first to fourth embodiments of the present invention, film formation by the AD method is performed while chaotically varying the relative position of the nozzle that injects PZT powder and the substrate. Further, the resist is removed and filling materials 511 are arranged in the space between the plural piezoelectric materials 513. Furthermore, on the plural piezoelectric materials 513, the upper electrodes 514 are formed, respectively, according to the sputtering method or the like. The substrate may be removed or left according to need in a completed product.

By the way, in FIG. 13, the lower electrode 512 and upper electrode 514 are provided to each piezoelectric material 513, however, one of those electrodes 512 and 514 may be provided as a common electrode.

In the manufacture of such an ultrasonic transducer array, merits of using the AD method are as follows.

Generally, the acoustic impedance Z of a living body is about 1.5 Mrayl, while the acoustic impedance Z of an ultrasonic transducer for living body is about 30 Mrayl. Here, the acoustic impedance is a value determined by a product of density of a material and a sound speed in the material. When two kinds of materials are in contact, the larger the difference between the acoustic impedances of those materials, the more easily ultrasonic wave is reflected at the boundary between them, that is, harder the ultrasonic wave is transmitted. Accordingly, in a normal ultrasonic transducer, the propagation efficiency of ultrasonic wave to the living body is not good, and therefore, one or more acoustic matching layers must be inserted between the ultrasonic transducer and the living body.

Here, by using the AD method when the piezoelectric material is formed, the density of the piezoelectric material can be controlled relatively easily. For example, by reducing the value of the acoustic impedance Z of the piezoelectric material close to the value in the living body, the propagation efficiency of ultrasonic wave to the living body can be made higher.

As a first method of controlling the density of the piezoelectric material by using the AD method, it is proposed that film formation is performed by mixing hollow silica or the like in the PZT powder as a raw material. Further, as a second method, it is proposed that the injection pressure when the PZT powder is injected from the nozzle is shifted from the optimum film formation condition. In this purpose, the injection pressure may be reduced, for example. Thereby, the packaging density of the piezoelectric material formed on the substrate or the electrodes becomes lower, and the piezoelectric material is deposited in a state of pressurized powder.

Thus, according to the AD method, the acoustic impedance value of the piezoelectric material can be manipulated, and therefore, an ultrasonic transducer array with good ultrasonic wave propagation efficiency to the living body can be fabricated. In addition, the acoustic matching layer can be omitted, the number of layers can be reduced, or the driving voltage of the ultrasonic transducer can be reduced.

Further, the merits of using the film forming method according to the present invention when the ultrasonic transducer array is manufactured by the AD method are as follows.

In the film forming apparatus according to the AD method, a nozzle having opening width of about 20 mm to 30 mm is normally used. Accordingly, it is difficult to form a film uniformly in a region having nearly the same width, and very difficult in a region having a larger width. However, in an ultrasonic probe for living body practically used in the medical fields, an ultrasonic transducer having a large area is required. For example, in an ultrasonic probe for abdomen, an ultrasonic transducer having a size of about 20 mm×100 mm is used. Further, in the case where the arrayed transducer array as shown in FIG. 13 is fabricated, even when the size of each ultrasonic transducer is small, uniform film formation in a large area is desired. At this point, according to the film forming apparatus and film forming method according to the present invention, regardless of the opening width of the nozzle, uniform film formation can be performed on a large area. Therefore, an ultrasonic transducer or an ultrasonic transducer array that can be applied to various kinds of ultrasonic probes can be fabricated.

Furthermore, the nozzle part to be used in the film forming apparatus according to the present invention can be applied to a sandblasting apparatus, for example. The sandblasting is a technology for grinding or cutting a target of machining by spraying abrasive grain toward the target of machining at a high speed. By applying the nozzle part according to the present invention as a nozzle for injecting such abrasive grain, uniform grinding in a large area can be performed.

The invention claimed is:

1. A film forming apparatus comprising:

a film forming chamber;

a substrate holder located in said film forming chamber, for holding a substrate on which a structure is to be formed;

exhaust means for exhausting an interior of said film forming chamber;

aerosol generating means for generating an aerosol by blowing up a raw material powder placed in a container with a gas;

introducing means for introducing the aerosol generated by said aerosol generating means into said film forming chamber;

at least one nozzle disposed oppositely to said substrate held by said substrate holder in said film forming chamber, for spraying the aerosol introduced via said introducing means toward said substrate; and displacing means for chaotically changing a relative position of said substrate held by said substrate holder and said at least one nozzle, wherein said displacing means includes a control unit that controls the relative position of said substrate and said at least one nozzle so that the relative position is chaotically changed, a first rotating support, and a second rotating support that rotates on the first rotating support, wherein a rotational axis of the first rotating support is parallel to and displaced from a rotational axis of the second rotating support, the control unit controls the rotation of the first support and the second support, and the substrate holder or the at least one nozzle is provided on the second support.

2. The film forming apparatus according to claim 1, wherein:

said first support and said second support each having at least one degree of freedom, said first support and said second support being connected such that degrees of freedom thereof overlap, and said control unit controlling each of said first support and said second support such that an end of the connected first and second supports exhibit chaotic behavior; and said substrate holder is provided on the end of the connected first and second supports.

3. The film forming apparatus according to claim 1, wherein:

said first support and said second support each having at least one degree of freedom, said first support and said second support being connected such that degrees of freedom thereof overlap, and said control unit controlling each of said first support and said second support such that an end of the connected first and second supports exhibit chaotic behavior; and said at least one nozzle is provided on the end of the connected first and second supports.

4. The film forming apparatus according to claim 3, wherein a carrying path for carrying the aerosol introduced by said introducing means is formed in each of said plurality of supports.

5. The film forming apparatus according to claim 4, wherein means for preventing deposition of the raw material powder included in the aerosol is provided in said carrying path formed in each of said plurality of supports.

6. The film forming apparatus according to claim 5, wherein said means for preventing deposition of the raw material powder includes an elastic reflection plate.

7. A film forming apparatus comprising:

a film forming chamber;

a substrate holder located in said film forming chamber, for holding a substrate on which a structure is to be formed;

exhaust means for exhausting an interior of said film forming chamber;

aerosol generating means for generating an aerosol by blowing up a raw material powder placed in a container with a gas;

introducing means for introducing the aerosol generated by said aerosol generating means into said film forming chamber;

at least one nozzle disposed oppositely to said substrate held by said substrate holder in said film forming chamber, for spraying the aerosol introduced via said introducing means toward said substrate; and displacing means for changing a relative position of said substrate held by said substrate holder and said at least one nozzle;

said displacing means includes a plurality of supports each having at least one degree of freedom, said plurality of supports being connected such that degrees of freedom thereof overlap, and control means for controlling each of said plurality of supports such that an end of the connected plurality of supports exhibit chaotic behavior; and said at least one nozzle is provided on the end of the connected plurality of supports;

wherein a carrying path for carrying the aerosol introduced by said introducing means is formed in each of said plurality of supports; and wherein a carrying path for carrying the aerosol introduced by said introducing means is formed in each of said plurality of supports.

* * * * *